US008434614B2

(12) United States Patent
Sato et al.

(10) Patent No.: US 8,434,614 B2
(45) Date of Patent: May 7, 2013

(54) STORING PACKAGE UNIT AND A STORING METHOD FOR MICRO SOLDER SPHERES

(75) Inventors: Isamu Sato, Tokyo (JP); Daisuke Souma, Tokyo (JP); Kazuo Fujikura, Tokyo (JP)

(73) Assignee: Senju Metal Industry Co., Ltd., Tokyo (JP)

( * ) Notice: Subject to any disclaimer, the term of this patent is extended or adjusted under 35 U.S.C. 154(b) by 55 days.

(21) Appl. No.: 13/123,585

(22) PCT Filed: Nov. 26, 2009

(86) PCT No.: PCT/JP2009/006383

§ 371 (c)(1),
(2), (4) Date: Apr. 11, 2011

(87) PCT Pub. No.: WO2010/064385

PCT Pub. Date: Jun. 10, 2010

(65) Prior Publication Data

US 2011/0198253 A1 Aug. 18, 2011

(30) Foreign Application Priority Data

Dec. 1, 2008 (JP) ..... 2008-306492

(51) Int. Cl.
*B65D 81/24* (2006.01)

(52) U.S. Cl.
USPC ..... 206/205; 206/524.8

(58) Field of Classification Search ..... 206/204, 206/720, 714, 524.8, 531, 532, 538, 1.8, 206/1.9, 205
See application file for complete search history.

(56) References Cited

U.S. PATENT DOCUMENTS

| | | | | | |
|---|---|---|---|---|---|
| 1,349,217 | A | * | 8/1920 | Mentzer | 206/1.8 |
| 2,107,239 | A | * | 2/1938 | Eckhoff | 206/1.8 |
| 2,424,898 | A | * | 7/1947 | Pressman | 220/23.2 |
| 2,446,361 | A | * | 8/1948 | Clibbon | 312/31.1 |
| 2,738,606 | A | * | 3/1956 | Klein | 206/1.7 |
| 3,726,645 | A | * | 4/1973 | Kaczmarek | 422/407 |
| 3,909,504 | A | * | 9/1975 | Browne | 174/524 |
| 4,767,004 | A | * | 8/1988 | Ishihara et al. | 206/718 |
| 4,852,732 | A | * | 8/1989 | Wilski et al. | 206/204 |
| 6,443,298 | B2 | * | 9/2002 | Kitamura et al. | 206/204 |

FOREIGN PATENT DOCUMENTS

| | | | |
|---|---|---|---|
| JP | 03085229 | A * | 4/1991 |
| JP | 3-289415 | | 12/1991 |
| JP | 11-105940 | | 4/1999 |
| JP | 2000-335633 | | 12/2000 |

(Continued)

OTHER PUBLICATIONS

International Search Report issued Mar. 9, 2010 in International (PCT) Application No. PCT/JP2009/006383.

*Primary Examiner* — David Fidei
(74) *Attorney, Agent, or Firm* — Wenderoth, Lind & Ponack, L.L.P.

(57) ABSTRACT

An object of the present invention is to prevent "deteriorations," such as oxidization and deformation of micro solder spheres during storage.
The micro solder spheres are packed in a container 2 comprising an air permeable material. A deoxidizing and drying agent 3 to be disposed externally to the container 2 is provided. The container 2 and the deoxidizing and drying agent 3 are placed in a bag member 4 impermeable to air, and the bag member 4 is sealed in an air-tight condition. Before sealing, the bag member 4 may be air evacuated. A plurality of containers 2 may be held by a holding member 5 such that they are fixed in positions relative to each other.

12 Claims, 7 Drawing Sheets

FOREIGN PATENT DOCUMENTS

| | | |
|---|---|---|
| JP | 2003-300559 | 10/2003 |
| JP | 2003-312744 | 11/2003 |
| JP | 2007-230613 | 9/2007 |
| JP | 2008-37487 | 2/2008 |

* cited by examiner

STORING PACKAGE UNIT AND A STORING METHOD FOR MICRO SOLDER SPHERES

TECHNICAL FIELD

The present invention relates to a storing package unit and a storing method suitable for storing solder spheres, and specifically micro solder spheres.

BACKGROUND ART

Recently, due to a trend in miniaturization of electronic equipment, electronic components for electronic equipment also have become significantly smaller in size, and yet constructed as multifunctional components having a number of functions. Such multifunctional components include BGA, CSP and the like, which is configured to include a number of electrodes disposed therein. When a multifunctional component is to be implemented in a printed board, solder is applied between the electrodes and lands of the printed board.

Other types of electronic component, such as QFP and SOIC, are configured to include a bare chip having internally a number of, electrodes, that are connected to the board of the electronic component by soldering.

In the soldering process as described above, if solder is separately and individually supplied to every one of a number of locations of placement or to significantly small electrodes, an excessive labor must be necessary. In addition, solder cannot be supplied precisely to each one of a respective micro soldering spot. Accordingly, in the practice of soldering involving multifunctional components or a bare chip, an amount of solder is previously attached to the electrode so as to form a solder bump thereon, which is then melted during soldering to produce a soldered connection. Generally, a solder sphere is used for forming a solder bump.

For formation of such solder bump, processes using solder paste, a solder sphere and the like are adopted. Traditionally, a process using solder paste, which is inexpensive in terms of the cost, has been adopted predominantly. However, under recent circumstances where a micro size of formed bump in a range of 30-200 μm is required, or owing to a fact that a height of implementation can be more reliably achieved by a bump formed a solder sphere, a process using a solder sphere having a diameter equal to a required bump height has become common in practice, though it is expensive in terms of the cost. Specifically, use of solder spheres is essential in an electrode for an external terminal of a BGA and CSP or an electrode for a bare chip connection inside a component, where achieving reliably a consistent height in implementation is of great importance.

To amount solder spheres on a number of electrodes, the solder spheres are introduced into a pallet with holes having a diameter smaller than the solder spheres formed therethrough. The pallet is vibrated to thereby seat the solder spheres in the holes in line with each other within the pallet. Then, the solder spheres are mounted on a solder sphere mounting head. Accordingly, if an aspect ratio of a solder sphere is large and/or there is larger deviation in grain diameter, the solder sphere cannot be loaded successfully on the electrode. Thus, it is important to ensure that there is no deviation in grain diameter of every one of the solder spheres in order to achieve reliably a precise amount of solder, and thus a consistent height of implementation.

The solder sphere, i.e. the subject of the present invention, is referred to as the solder in a spherical form used in implementation, and for use in the mounting process as described above, must satisfy conditions, including: (1) having a sphericity of solder sphere not less than 0.95, and a fixed grain diameter with less distortion; (2) having no contamination on the surface of the sphere; (3) having less rougher and smooth surface; (4) having no relatively thick oxide film over the surface; and (5) having a fixed content of alloy composition.

To achieve the foregoing, a container for storing the solder spheres must also be such that will not affect a grain diameter of a solder sphere. Moreover, it is required to prevent, in addition to any deformation due to impact from the outside to the solder spheres, such as the phenomenon referred to as blacking that occurs when the solder spheres move and rub against each other within the container, leading to cracks in the surfaces of the spheres, resulting in solder powders, which oxidize and blacken. In order to prevent such blacking, a known solution has suggested a cylindrical container body having a bottom an opening of which is sealed with a lid having an inwardly protruding member so as to reduce a space available for movement of the solder spheres (Patent Literature 1).

In addition, as the solder spheres become smaller, and thus the ratio of surface area to total volume of the solder spheres increases, the surfaces of the solder spheres are more likely to become oxidized and turn yellow. Such yellowing of the solder spheres is due to the fact that the solder spheres are exposed to the atmosphere and Sn in the solder spheres is oxidized by oxygen in the atmosphere. As the oxide film of the Sn colors yellow, the film, as it becomes thicker, causes the entire solder sphere to appear yellowish.

Mounting of the solder spheres, such as in the BGA implementation, in which the solder spheres are aligned on the pallet and mounted together as a block requires that a presence of the solder spheres be confirmed by an image recognition device, after mounting of the solder spheres. In this process, any yellowish coloring of the solder spheres may cause an error detected in the image recognition device. Such an error, once detected by the image recognition device, may cause a stoppage of the production line, thereby seriously affecting productivity.

In addition, if a surface of the solder sphere is covered with oxide film, such oxide film may on occasion not be broken during melting of the solder sphere, and may thus remain on the electrode as held in the sphere profile or adhere to the electrode, which may inhibit wetting by the melted solder and lead to bad soldering.

In light of the circumstances as noted above, some types of containers directed to prevent oxidization and yellowing of Sn-based lead-free solder spheres have been suggested. (Patent Literature 2 to 5).

A simple but effective method for preventing yellowing of solder spheres is to pack solder spheres in a laminated sheet or an aluminum sheet that is impermeable to air and from which air is evacuated and then sealed with solder spheres loaded therein (Patent Literature 2). It is also possible to include a deoxidant or absorbent or a buffering member enclosed together in the inside thereof.

There is another known method, in which a space for receiving a deoxidant is created inside a solder sphere storing container having an oxygen barrier property as well as conductivity, so that inclusion of the deoxidant received in said space may function to prevent oxidization of the solder spheres (Patent Literature 3).

There are other known methods, including one using, instead of the deoxidant received in the container, a container comprising a resin material that contains an antioxidant component or another using a member containing the antioxidant component, which is received together with the solder spheres inside the container (Patent Literature 4).

In yet another known method, an outer lid of the container body is adhered with a seal in order to prevent oxidization of the solder spheres (Patent Literature 5). According to this method, once the seal is removed and the container is placed in an unsealed condition, the solder spheres inside must all be consumed, as oxygen will flow into the container and the oxidizing process will start after unsealing of the container. Any solder spheres remaining unused will therefore no longer be usable, as they will be oxidized. Accordingly, the bad soldering due to the oxide film may be prevented.

Though not specifically a storage container for solder spheres, there is a known packaging method for storing a metal wiring material, such as a wire and a ribbon, made of metal, such as copper and solder, that is more likely to be oxidized (Patent Literature 6). According to this method, the metal wiring material is wound around a spool, which is contained in a plastic case, and the whole case along with a deoxidant is sealed by a laminated sheet.

Citation List

Patent Literature

PTL 1: Japanese Patent Laid-open Publication No. 2000-335633

PTL 2: Japanese Patent Laid-open Publication No. 2003-312744

PTL 3: Japanese Patent Laid-open Publication No. Hei11-105940

PTL 4: Japanese Patent Laid-open Publication No. 2007-230613

PTL 5: Japanese Patent Laid-open Publication No. 2008-37487

PTL 6: Japanese Patent Laid-open Publication No. Hei03-289415

SUMMARY OF INVENTION

Technical Problem

The above-described methods for storing solder spheres, however, are subject to some problems.

Although a container comprising a cylindrical container body having a bottom, an opening of which is sealed with a lid having an inwardly protruding member can prevent blacking caused by solder spheres rubbing against each other, use of such a container is not intended to address anti-oxidization, and consequently solder spheres may possibly be oxidized and turn yellowish.

A method intended to prevent yellowing of solder spheres in which the solder spheres are packed in a bag consisting of a laminated sheet or aluminum sheet, which is air evacuated and then sealed with the solder spheres loaded therein may allow an external impacts to act directly on the solder spheres. Thus, if the bag is placed in an environment susceptible to such external impact, deformation or distortion of the solder spheres may result. In the case of inclusion of a deoxidant or absorbent or a buffering member enclosed together, when it is removed, the micro solder spheres may be caused to inadvertently scatter.

The method in which a space for receiving a deoxidant is created inside a solder sphere storing container having oxygen barrier properties as well as conductivity, so that inclusion of the deoxidant received in said space can function to prevent oxidization of the solder spheres, may not be abler to exert any effect in preventing the sphere surfaces from tarnishing. This is because Fe, a basic component of the deoxidant, will be ionized by moisture in the container and react with Sn to tarnish the sphere surfaces. Such tarnishing may also cause an error in image recognition. In addition, reserving room for receiving the deoxidant within the container may increase an overall size of the container, disadvantageously leading to poor handling during processing.

The method using, instead of the deoxidant received in the container, a container comprising a resin material that contains an antioxidant component or a method using a member containing the antioxidant component, which is received together with the solder spheres inside the container may problematically increase the production cost of the container.

A variety of materials can be used for containers or packaging materials, and if the containers, such as those used with solder spheres that are to be consumed daily, are made of hardly recyclable materials, there will result a problematic effect on the environment.

The method in which an outer lid of the container body is adhered with a seal is subject to a condition wherein once unsealed, all of solder spheres must be consumed and the seal would not be able to be affixed again. Thus, there will be a problem that if not exhausted all at once, the remaining solder spheres would be wasted. Also, the method is not intended to provide a sufficient anti-oxidization measures.

According to the packaging method suggesting that a metal wiring material is wound around a spool, which is received in a plastic case, and the whole case along with a deoxidant is enclosed by a laminated sheet, the deoxidant external to the case would not act effectively on the materials inside the case. The same applies to a case in which an absorbent is used in place of the deoxidant.

Thus, an object of the present invention is to provide a storing package unit and a storing method for micro solder spheres that solves the problems of the prior art, so as to prevent "deterioration", such as oxidization and deformation, of micro solder spheres.

Solution to Problem

In order to solve the problems stated above, according to the present invention, there is provided:

a method for storing micro solder spheres, comprising the steps of;

packing micro solder spheres in a container comprising an air permeable material;

providing a deoxidizing and drying agent to be disposed externally to the container; and placing the container and the deoxidizing and drying agent in a bag member impermeable to air and sealing the bag member in an air-tight condition.

The method may further include, after placing the container and the deoxidizing and drying agent in the bag member and before sealing the bag member in an air-tight condition, a step of evacuating air from the inside of the bag.

According to the present invention, there is further provided:

a storing package unit for micro solder spheres, comprising:

a container in which micro solder spheres are contained;

a deoxidizing and drying agent disposed externally to the container; and a bag member impermeable to air, in which the container and the deoxidizing and drying agent are contained and which is sealed in an air-tight condition, the storage package unit characterized in that the container comprises an air permeable material.

The inside of the bag may be air evacuated.

A plurality of the containers may be arranged, and the storing package unit may further comprise a holding member for allowing the plurality of containers to be held in fixed positions relative to each other.

The holding member may be adapted to encompass the plurality of containers.

The holding member may have a bump for buffering any impact imparted from outside.

If the deoxidizing and drying agent is disposed externally to the holding member, the holding member should be constructed to have air permeability.

The holding member may comprise an air permeable material.

The holding member may have a vent hole.

The holding member may have a recess for allowing the deoxidizing and drying agent to be seated in place.

The holding member may also be a connecting member for making a connection between the plurality of containers, and the connecting member may be structured to be breakable by hand.

The container may have a self-standing property.

The container may have a container body and a lid member for covering an opening of the container body.

The container is made of a transparent or translucent resin.

The container may have conductivity.

The holding member may be also made of a transparent or translucent resin.

Preferably, the container may be made of polyethylene terephthalate suitable for recycling.

Preferably, the holding member may be also made of polyethylene terephthalate as suitable for recycling.

A container comprising an air permeable material, which may be used in a storing method for micro solder spheres in accordance with the present invention, may have:

a container body to be packed with micro solder spheres, an inner lid member and an outer lid member, wherein the inner lid member is sized to fit in the opening of the container body in a loose-fit condition, and the outer lid member and the container body are adapted to hold the inner lid member such that there is no clearance allowing for the passage of micro solder spheres to be produced between the inner lid member and the container body, when the outer lid member is mounted in the opening of the container body.

Advantageous Effects of Invention

According to the present invention, since the container in which the micro solder spheres are to be contained is constructed from an air permeable material and the deoxidizing and drying agent disposed externally to the container is contained along with the container inside the bag member, which is then sealed in an air-tight condition, an effect from the deoxidizing and drying agent can act on the solder spheres thoroughly within the container. The deoxidizing and drying agent used herein is one that is capable of deoxidizing and additionally absorbing moisture, so that it can function to prevent oxidization of the subject due to oxygen and moisture. Thus, an effect from the deoxidizing and drying agent is of use in inhibiting oxidization and yellowing of surfaces of the solder spheres. When the deoxidant is used alone, Fe, or the base component of the deoxidant will be ionized by the moisture in the container and react with Sn, which may lead to oxidization of the solder spheres; while use of the deoxidizing and drying agent, owing to its moisture absorbing ability, can also remove moisture that otherwise may cause ionization, so that the oxidization due to both factors, one from oxygen and the other from moisture, can be prevented.

The air permeable material used to construct the container may be a highly processable material having an appropriate strength, for example, a resin such as PET, which allows for inexpensive production of the container. Further, use of the storing method of the present invention can prevent any deformation of the solder spheres, which may be caused by dropping of or loading on top of the storing container for spheres and the holding member of the storing container. Further, production of the storing container for spheres and/or the holding member of the storing container by use of a PET material results in a lesser environmental impact as compared with other materials, such as PP (polypropylene) and PS (polystyrene), for example. This is because the PET material provides an easier and wider range of measures for recycling wherein it may be reused as fibers or recycled resin moldings. The use of the PET material, specifically when used in production of containers intended to store products to be consumed, such as micro solder spheres, is preferable from a viewpoint that it has less impact on the environment and is recyclable in various applications.

Since a deoxidant is not used, yellowing due to Fe will not occur.

Since the deoxidizing and drying agent is disposed externally to the container, the container in itself can be made compact, which may facilitate handling of the container. In addition, a rise of solder spheres scattering is alleviated at such time as the absorbent is removed from the container, which has been concerned with the prior art.

If some solder spheres remain unused, they can be stored satisfactorily in a good condition by enclosing a new deoxidizing and drying agent in the bag member and then resealing the opening of the bag member securely by means of thermocompression or the like. A sealing tape or the like may also be used for resealing.

Other effects of the present invention will become apparent from the description given below.

DESCRIPTION OF EMBODIMENTS

Referring now to the attached drawings, an embodiment of the present invention will be described.

Figure 1:
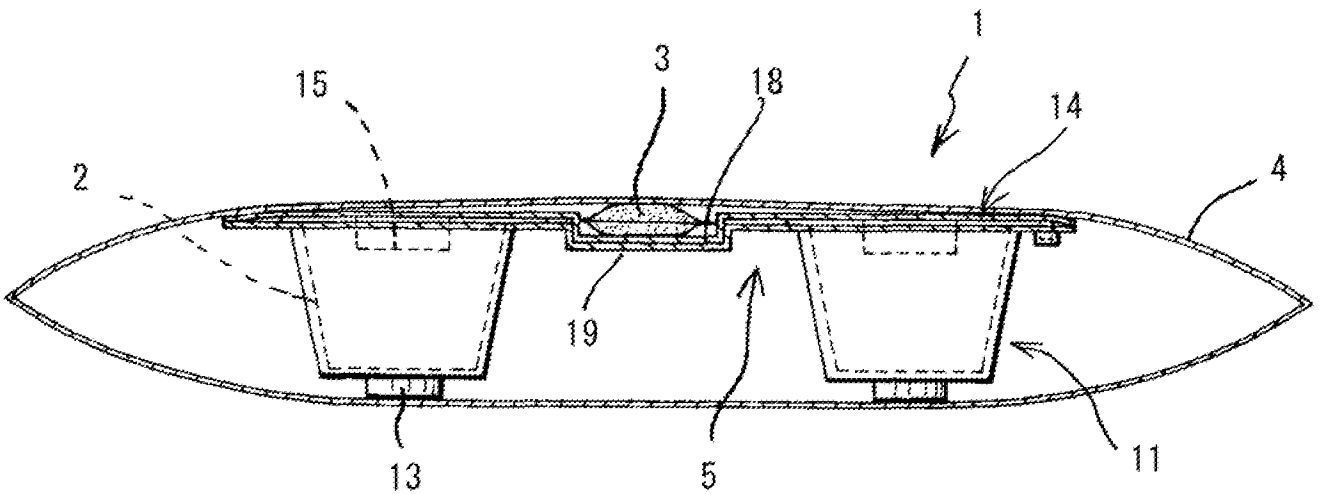
FIG. 1 is a longitudinal sectional view showing an embodiment of a storing package unit for micro solder spheres according to the present invention.
Figure 2:
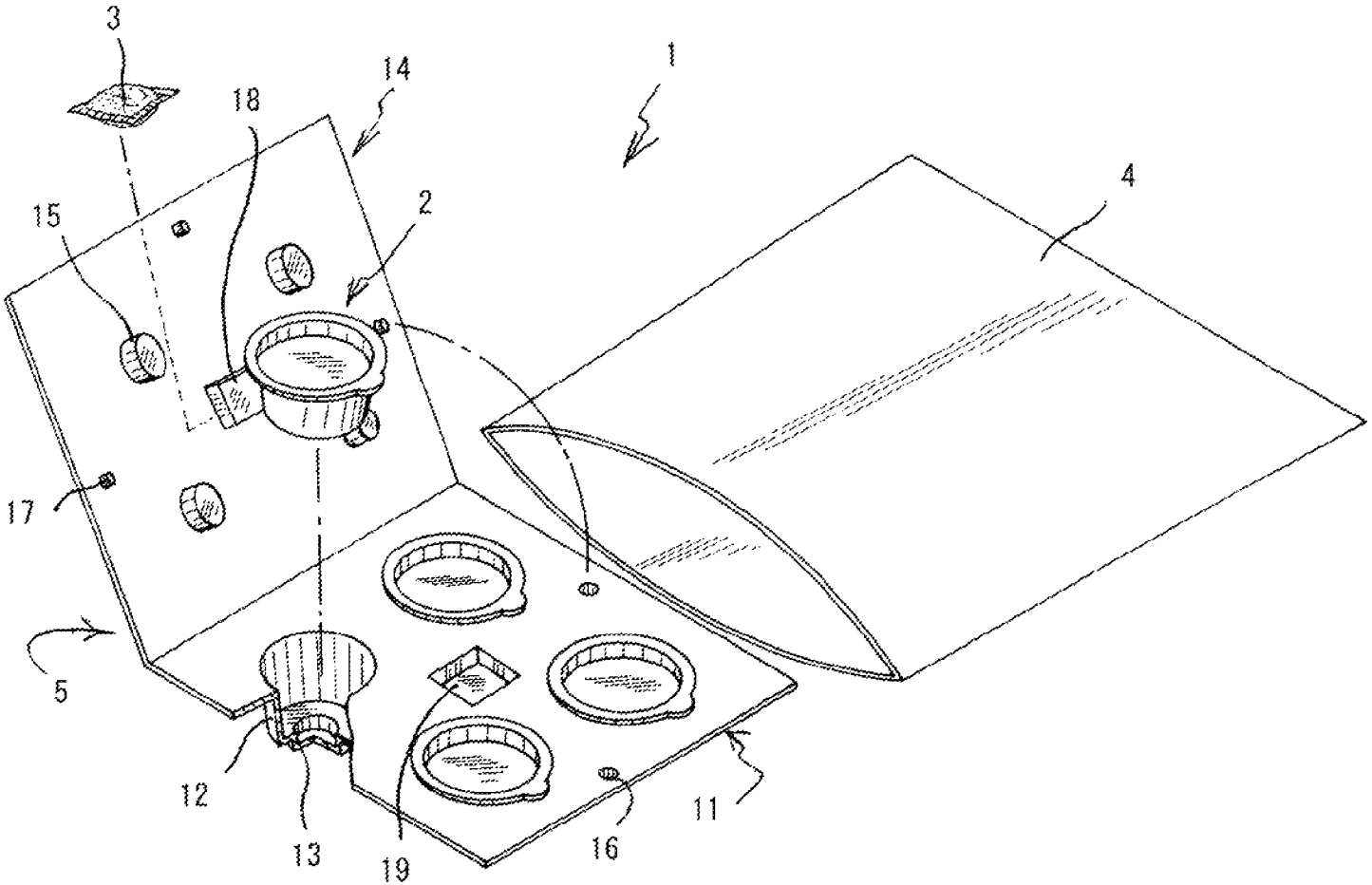
FIG. 2 is a perspective view showing the package unit of the present invention before it is sealed.

FIG. 1 is a longitudinal sectional view showing an embodiment of a storing package unit for micro solder spheres according to the present invention. FIG. 2 is a perspective view showing the package unit before it is sealed. Specifically, in a package unit 1, a container 2 comprising an air permeable material in which are packed micron solder spheres, with a deoxidizing and drying agent 3 being disposed externally to the container 2 are all contained in the bag member 4, which is impermeable to air, and the bag member 4 is sealed in an air-tight condition. In the illustrated embodiment, a plurality of containers 2 are encompassed with a holding member 5.

After the container 2 and the deoxidizing and drying agent 3 have been placed in the bag member 4, the inside of the bag member 4 may be air evacuated before the bag member 4 is sealed in an air-tight condition. It is to be noted that the inside of the bag member 4 may have an inert atmosphere consisting of nitrogen, argon or the like.

Figure 3:
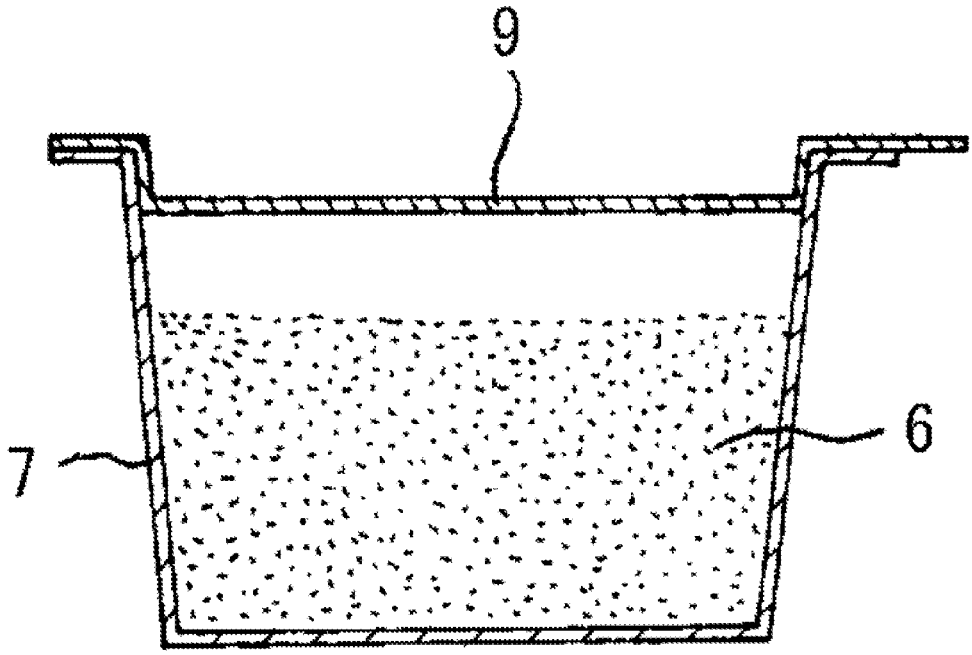
FIG. 3 is a sectional view of a container.
Figure 4:
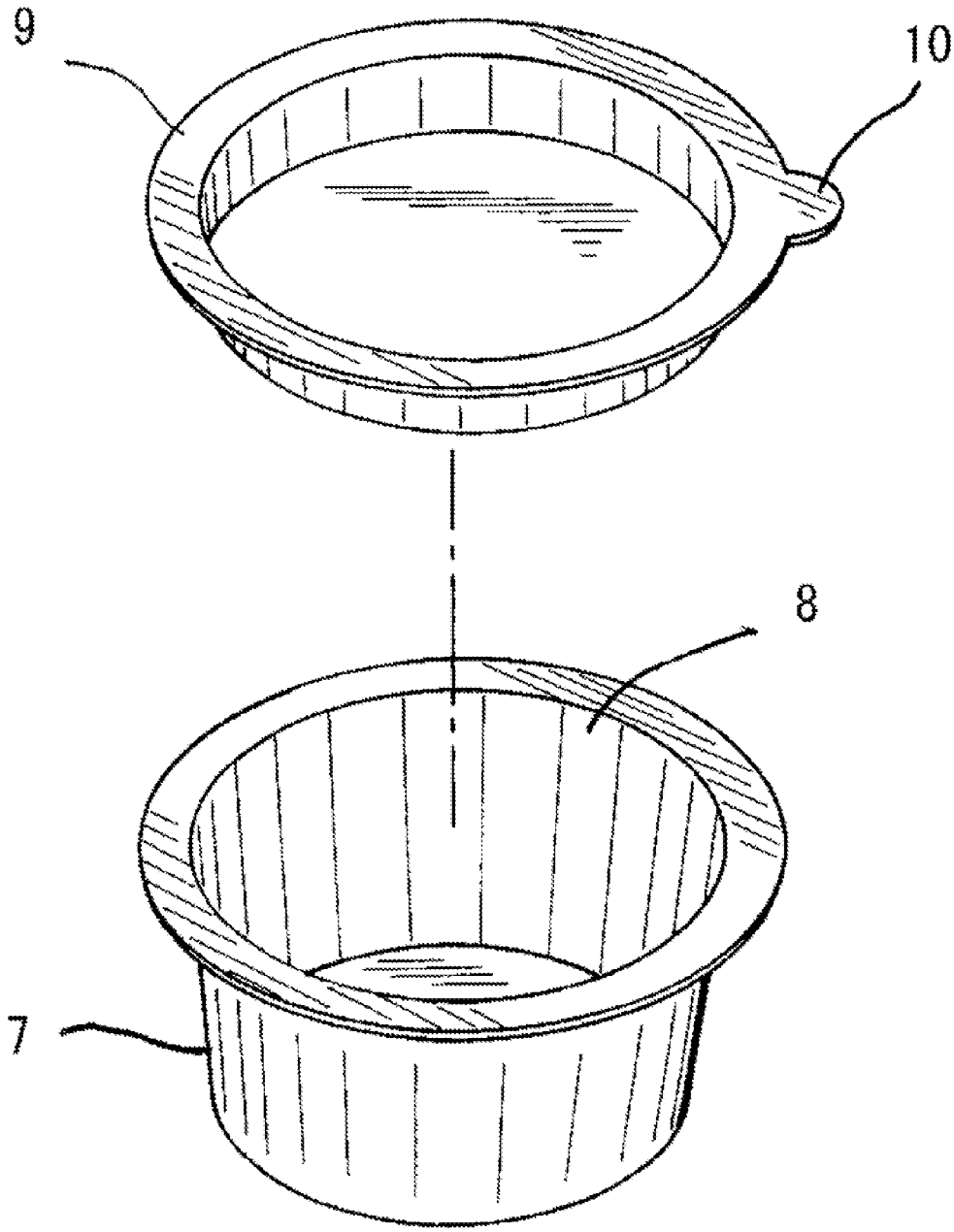
FIG. 4 is a perspective view of the container.

FIG. 3 is a vertical sectional view of the container 2, and FIG. 4 is an exploded perspective view of the container 2. The container 2 has a container body 7 in which micro solder spheres 6 (diameter of the sphere around 70 μm) are to be contained and a lid member 9 for covering an opening 8 of the container body 7. The container body 7 and the lid member 9 are fitted with each other at their tapered portions. This fitting is sufficiently tight to prevent the lid member 8 from being inadvertently removed, while the lid member 9 may be provided with a lug 10 to allow the lid member 9 to be removed easily by hand. If there are unused solder spheres 6 remaining inside, the opening 8 may be closed again by the lid member 9.

One of the features of the present invention consists in that the deoxidizing and drying agent 3 is disposed externally to the container 2 and the container 2 for containing the micro solder spheres 6 comprises the air permeable material. The air permeable material may include one consisting of a resin material, such as PET, for example. The resin material is capable of providing the container 2 with a strength to make the container resistant against a certain magnitude of impact and also highly processable. The reason why the container 2 is not simply provided with a vent hole but the material for the container 2 employs the air permeable material is because it is intended to allow an effect externally from the deoxidizing and drying agent 3 to act on the micro solder spheres 6 thoroughly within the container 2. The effect via vent holes provided at a plurality of limited locations may be poorer than that obtainable via a large number of micro pores provided over the entire air permeable material, and further the vent holes could cause leakage of the micro solder spheres 6.

Preferably, the container 2 may be made of a transparent or translucent material so that a presence of the micro solder spheres 6 inside can be confirmed visually.

In this regard, the holding member 5 may be also made of a transparent or translucent material, thereby allowing a presence of the micro solder spheres 6 within the container 2 to be visually confirmed externally to the holding member 5.

Further, the container 2 may preferably have a conductivity in order to prevent the micro solder spheres 6, during the solder spheres 6 within the container 2 being transferred onto a pallet, from adhering to the container body 7 or the lid member 9 due to static electricity, or in a worst case, scattering around. For this purpose, the container 2 may be coated with a conductive material.

There may be variations from the embodiment of the container 2. For convenience when the micro solder spheres 6 in the container 2 are transferred onto the pallet, a small aperture for removing the solder spheres may be formed in a part (e.g., a central part) of the lid member 9, and the small aperture may be covered with another small lid member.

Figure 7:
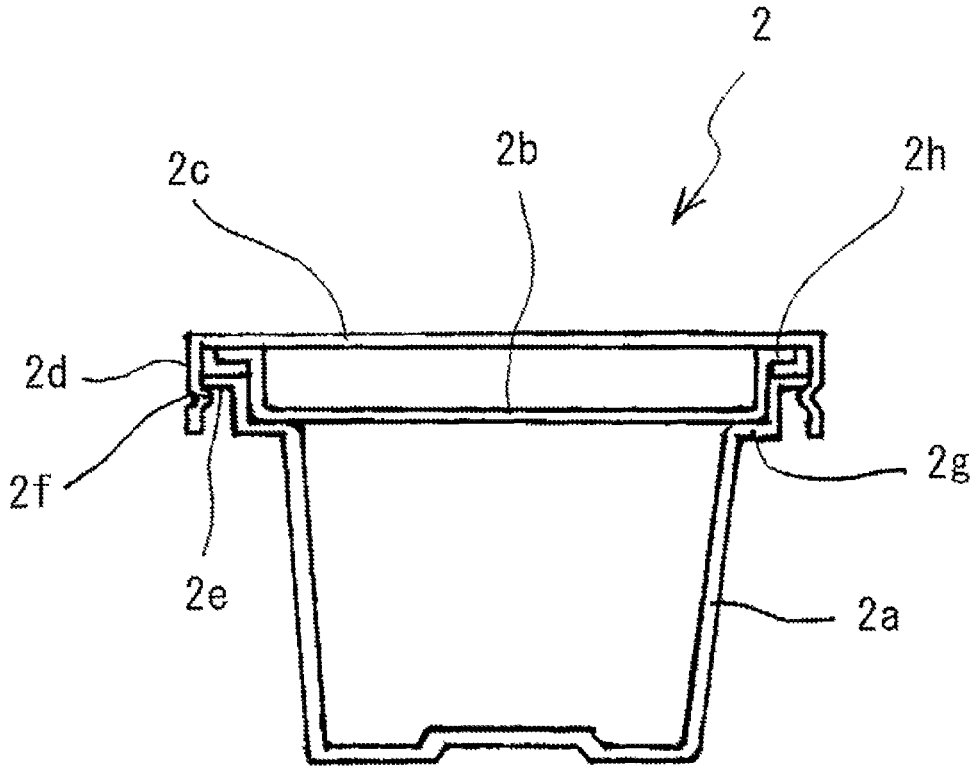
FIG. 7 is a longitudinal sectional view of a container of another embodiment.

The container 2 in another embodiment, as illustrated in FIG. 7, may have a container body 2*a*, an inner lid member 2*b* and an outer lid member 2*c*. The inner lid member 2*b* is sized to fit in an opening of the container body 2*a* in such a loose-fit condition that there will be a clearance in a range of 50 μm to 200 μm, for example, to be created between the inner lid member 2*b* and the opening of the container body 2*a*. Therefore, the inner lid member 2*b* is not substantially susceptible to any frictional resistance when it is mounted to and removed from the container body 2*a*.

On the other hand, the outer lid member 2*c* is configured to be securely mounted to the container body 2*a* so as not to be removed inadvertently. For this purpose, a vertical flange 2*d* of the outer lid member 2*c* may be provided with a raised portion 2*f* for engagement with a horizontal flange 2*e* of the container body 2*a*.

When the outer lid member 2*c* is mounted to the container body 2*a*, the outer lid member 2*c* and the container body 2 can hold the inner lid member 2*b* in such a manner that there will be no clearance allowing for the passage of the micro solder spheres to be produced between the inner lid member 2*b* and the container body 2*a*. Specifically, they may be arranged such that when the outer lid member 2*c* is mounted to the container body 2*a*, the inner lid member 2*b* can be clamped between the outer lid member 2*c* and a shoulder portion 2*g* of the container body 2*a*. This may achieve a close contact condition or a clearance of such a size that would not allow passage of the micro solder spheres between a peripheral edge of a bottom surface of the inner lid member 2*b* and a top surface of the shoulder portion 2*g* of the container body 2*a*.

In another aspect (not shown) of holding the inner lid member 2*b*, a horizontal flange 2*h* of the inner lid member 2*b* may be clamped between the outer lid member 2*c* and a horizontal flange 2*e* of the container body 2*a*.

An advantage of the container of FIG. 7 consists in that the provision of the inner lid member 2*b* can eliminate a risk that impact upon removal of the outer lid member 2*c* would cause the micro solder spheres within the container body 2*a* to jump out of the container. In addition, since the inner lid member 2*b* is in a loose fit with the opening of the container body 2*a*, no impact would be produced upon removal of the lid. Thus, when the inner lid member 2*b* is removed, there will be no risk of the micro solder spheres jumping out of the container.

The micro solder spheres in the container body 2*a* are usually consumed all at once. However, occasionally, micro solder spheres may be saved in the container body 2*a* for subsequent use. Taking such a case into account, the shoulder portion 2*g* may be inwardly beveled so that the micro solder spheres will not remain on the shoulder portion 2*g* of the container body 2*a*.

Further, although the illustrated container 2 comprises the container body and the lid member, it may be constructed as a unitary container. Such a unitary container may be produced by introducing the solder spheres 6 through an inlet into the container so as to be contained therein, and then closing the inlet by means of adhesion and the like method. When the solder spheres are to be taken out, for example, a weakened region formed in a part of the container may be broken to create an opening through which the solder spheres can be taken out.

Still further, although the illustrated container 2 has a self-standing property and as it is, the container 2 can resist against a certain magnitude of impact, if the container 2 is used in an environment less susceptible to impact from the outside, the self-standing property is not required for the container 2. In this case, the container may be a flexible bag-like member.

Figure 5:
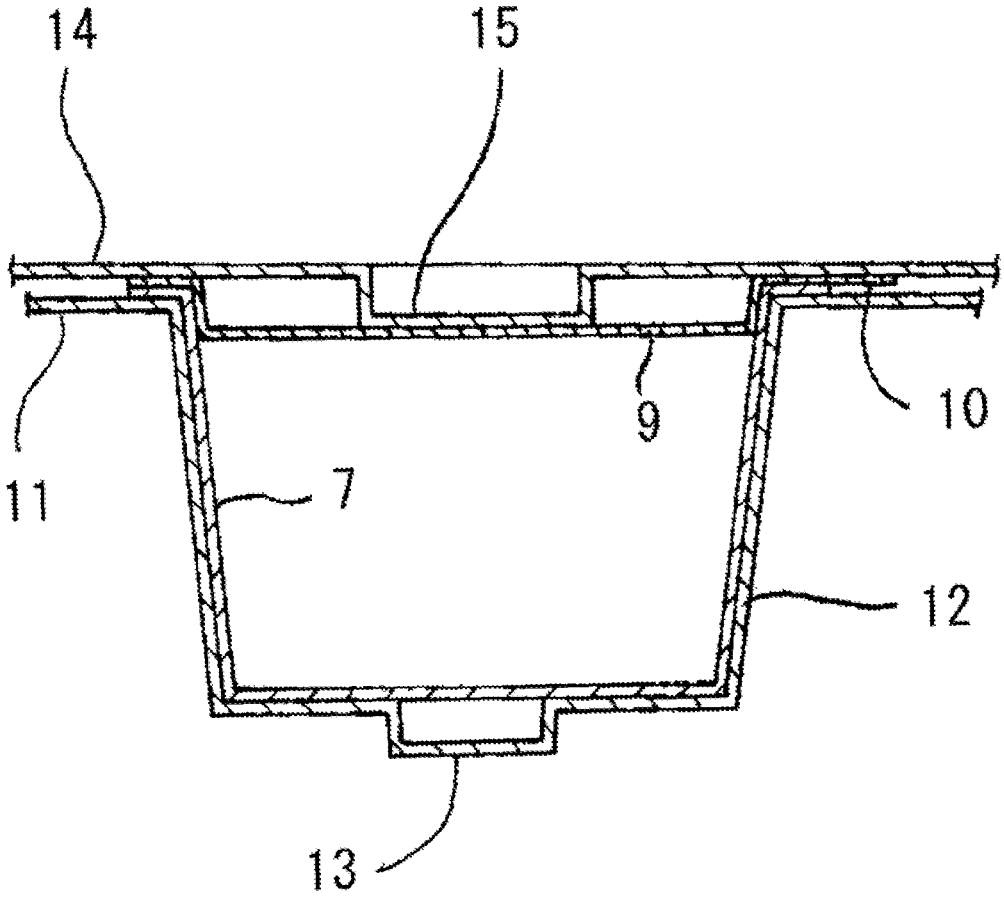
FIG. 5 is a partial sectional view of the container fitted in a holding member.

Again referring to FIGS. 1 and 2 in conjunction with FIG. 5. In the illustrated embodiment, a plurality of containers 2 is fully encompassed with the holding member 5 and also fixedly held in their positions relative to each other. Specifically, the holding member 5 is constructed from a deployable and collapsible member made of a resin and has receptacles 12 formed in a lower plate member 11 for receiving the containers 2. Each of the receptacles 12 has a buffering bump 13 formed in the bottom for buffering the impact from the outside. The instance of impact from the outside, as used in this case, implies an impact due to dropping. Similar bumps may be arranged in appropriate locations in order to buffer against other types of impacts.

An upper plate member 14 of the holding member 5 has a downward protrusion 15 formed so as to compress the lid member 9 of the container 2 received in the receptacle 12. When the upper plate member 14 is folded over the lower plate member 11, the downward protrusion 15 allows the container 2 to be held stable in the receptacle 12. Those holes 16 and protrusions 17 arranged respectively in the lower plate member 11 and the upper plate member 14 can cooperate with each other so as to hold both plate members 11 and 14 in the folded condition.

A recess 18 is formed in a central region of the upper plate member 14, in which a pack of deoxidizing and drying agent 3 is to be seated. A recess 19 is formed in the central region of the lower plate member 11 to accommodate a corresponding downward protrusion that has emerged in formation of the recess 18.

Although the deoxidizing and drying agent 3 may be disposed internally in the holding member 5, if it is disposed externally to the holding member 5, as in the illustrated embodiment, then the holding member 5 fully encompassing the container 2 is also required to have air permeability. This is intended to allow an effect of the deoxidizing and drying agent 3 to act on the container 2, and thus on the solder spheres 6 in the container 2. In order to provide the holding member 5 with air permeability, the holding member 5 in itself may be made of an air permeable material or at least one vent hole may be formed in the holding member 5. Such a vent hole may also be arranged in the holding member 5 comprising the air permeable material.

The micro solder spheres are packed in the container 2 and the container 2 is then placed in the receptacle 12 of the holding member 5, and after the lower plate member 11 and the upper plate member 14 having been closed over each other, the deoxidizing and drying agent 3 is placed in the recess 18. The container 2, the holding member 5 and the deoxidizing and drying agent 3 are introduced into the bag member 4. The bag member 4 is a member impermeable to air. A sheet used for the bag member 4 should have a sufficiently low oxygen permeability and a sufficiently low water vapor permeability. Preferably, it should have a rate of oxygen permeability such that a daily volume of oxygen able to permeate through the sheet is restricted to less than 10 ml per 1 $m^2$ of sheet area, when placed in an environment having a temperature of 23° C., a humidity of 0% and an atmospheric pressure of 1 MPa. Preferably, it has such a rate of water vapor permeability that only allows a daily volume of water content permeating through the sheet less than 1 gram per 1 $m^2$ of sheet area, when placed in an environment having a temperature of 40° C., and a relative humidity of 90%. The bag member 4 may be made of an aluminum sheet material. Alternatively, an air permeable material may be coated with aluminum or the like so as to provide impermeability to air.

Further, the deoxidizing and drying agent used herein is one capable of deoxidizing and additionally absorbing moisture, so that it can function to prevent oxidization of the subject due to oxygen and moisture. In this connection, a commercially available product, for example, the RP agent (brand name of the product from Mitsubishi Gas Chemical Co., Inc.) may be used as the deoxidizing and drying agent.

After the container 2 and the deoxidizing and drying agent 3 having been placed in the bag member 4 and before the bag member is sealed, the inside of the bag member 4 may be air evacuated.

In the illustrated embodiment, although the holding member 5 holds four containers 2, five or more or three or less container(s) 2 may be held by the holding member 5. If the holding member 5 holds a greater number of containers 2, then an amount of deoxidizing and drying agent 3 used may be increased.

When the solder spheres are to be consumed, the bag member 4 is partially broken, and the holding member 5 may be taken out and then opened so as to allow the container 2 to be taken out. The lid member 9 for the container 2 is removed and the solder spheres 6 therein may be supplied onto a pallet. The container 2, which is not to be used, may remain fitted in the holding member 5 and returned into the bag member 4 together with a new unused deoxidizing and drying agent 3. The broken area of the bag member 4 should be closed by applying a reliable seal by means of thermocompression or the like, so as not allow ingress of outside air. If not all of the solder spheres in a single container 2 are consumed, the container 2 is closed by the lid member 9 and placed back into the holding member 5 and then into the bag member 4, and the bag member 4 is then resealed.

Figure 6:
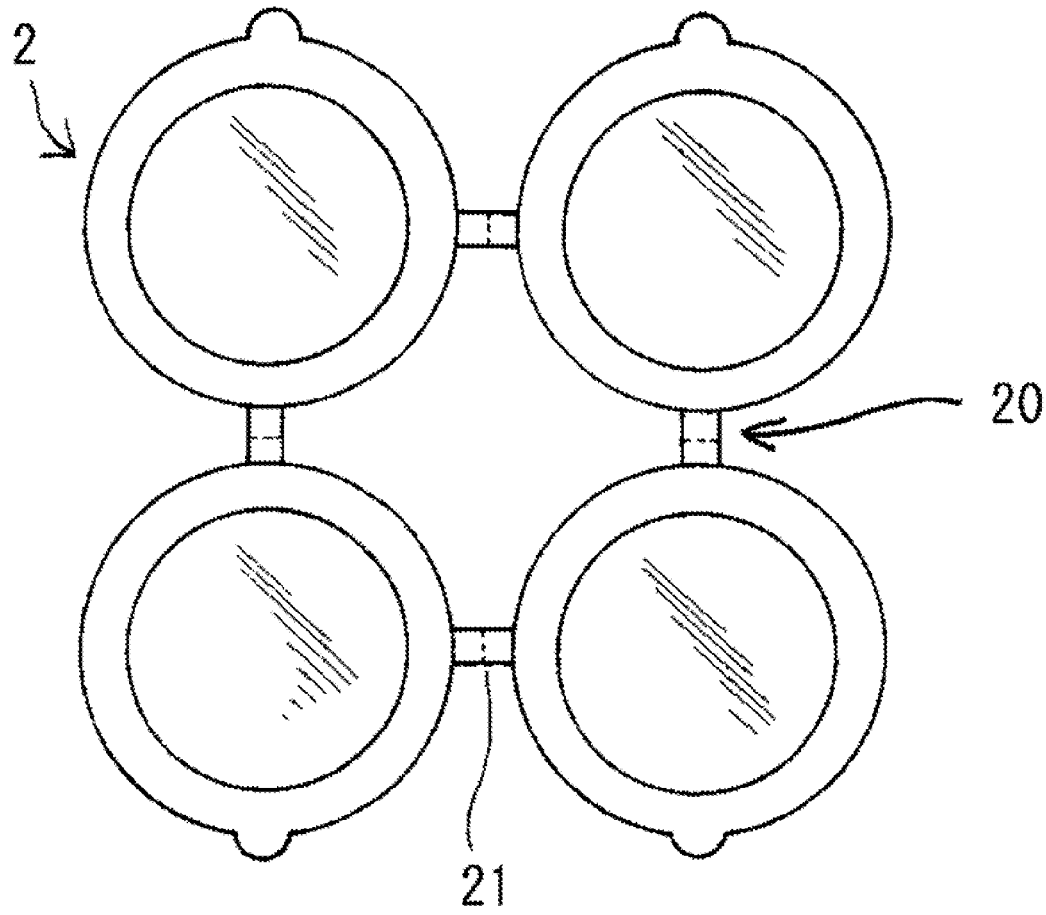
FIG. 6 is a plan view showing a holding member of another embodiment along with the container.

FIG. 6 shows a holding member of another embodiment. This holding member is formed to extend laterally from the container body as a connecting member 20 for making a connection between containers 2. A central area of the connecting member 20 is a weakened area 21, and a user can manually break the weakened area 21 as needed. Although the connecting member 20 is not capable of protecting the solder spheres in the container 2 against an impact from the outside, such as dropping or the like, it can alleviate an impact such as vibration and the like, and also inhibit significant vibrating motion of respective containers 2 by holding a plurality of containers 2 fixedly in their positions relative to each other.

EXAMPLES

To verify the effect of the present invention, a review was conducted as in the table shown below. The embodiment as illustrated in FIGS. 1 and 2 was taken as Example 1, wherein micro solder spheres, each having a diameter of 70 μm was packed in a PET container (volume of 40 cc) up to 80% of its volume, and the PET container was held by a PET tray (the holding member) and covered with a aluminum-coated bag (the bag member) along with the RP agent (the deoxidizing and drying agent).

Example 2 represents one wherein the container was not held by the holding member in the Example 1.

Comparative Example 1 represents one wherein instead of the RP agent, a deoxidant was enclosed in the Example 1.

Comparative Example 2 represents one wherein the container was not held by the holding member and not covered with the aluminum-coated bag in the Example 1.

Comparative example 3 represents one wherein the micro solder spheres were packed in a glass bottle, with which additionally the RP agent was enclosed and then capped.

Comparative Example 4 represents one wherein the micro solder spheres were packed in an aluminum-coated bag, with which additionally the RP agent was enclosed and then sealed.

In the comparative examples as described above, the micro solder spheres were packed in an amount of 80% to the volume of each specific container or package. The micro solder spheres used were the same as in the Examples, each having the diameter of 70 μm.

A test method for determining yellowing was carried out as follows. Respective Examples and Comparative Examples were placed in a tank having constant temperature and humidity of 30° C. and 70% respectively, and after 30 days (720 hours), they were taken out and a degree of yellowing on the surfaces of the micro solder spheres was determined by using a spectrophotometer. The appliance used was the spectrophotometer CM-3500d manufactured by Konica Minolta Holdings, Inc.

A test method for determining the oxide film was similar to the test method used for determining the yellowing, and a thickness of the oxide film over the surface of the micro solder sphere in each of the Examples and Comparative Examples was determined by the Auger electron spectroscopy. The appliance used was the PHI-700 manufactured by Ulvac-Phi Inc.

To determine a distortion rate of the solder sphere, the micro solder spheres were packaged according to each of the Examples and Comparative Examples and placed in one of a cardboard box. Subsequently, a weight of 100 kg was loaded on each of the cardboard boxes and the sphericity of the solder sphere was determined by using the CNC image determination system. The appliance used was the ULTRA Quick Vision, ULTRA QV350-PRO, manufactured by Mitutoyo Co., Ltd.

A static electricity test was carried out by inducing static electricity in the micro solder spheres and counting the number of micro solder spheres adhering to the aluminum-coated bag or cap in any given 1 square millimeter area, when the bag or cap was opened.

For a drop-down test, 20 packages, each packed with solder spheres, were packed in a cardboard box. The top and bottom as defined in the packing of the box remained unchanged and the box was dropped down twice from a height of 50 centimeters. After dropping, the box was opened and an extent of damage to the container and the like was evaluated.

TABLE 1

| | | Packaging means | Yellowing (color number) | Oxide film | Solder sphere sphericity | Static electricity test (spheres) | Drop-down test |
|---|---|---|---|---|---|---|---|
| Example | Example 1 | PET(ESD container) + RP agent + aluminum-coated bag + PET tray | 3.13 | 1.5 nm | 0.99 | 0 | No problem |
| | Example 2 | PET(ESD container) + RP agent + aluminum-coated bag | 3.16 | 1.5 nm | 0.97 | 0 | Lid opened in four of the containers, solder spheres scattered around |
| Comparative Example | Comparative Example 1 | PET(ESD container) + deoxidant + aluminum-coated bag + PET tray | 7.12 | 11 nm | 0.99 | 0 | No problem |
| | Comparative Example 2 | PET(ESD container) + RP agent | 8.39 | 12 nm | 0.98 | 0 | Lid opened in two of the containers, solder spheres scattered around |
| | Comparative Example 3 | Glass bottle + RP agent | 3.06 | 1.5 nm | 0.99 | 7 | No problem |
| | Comparative Example 4 | Aluminum-coated bag + RP agent | 3.19 | 1.5 nm | 0.89 | 23 | No problem |

Results from the verification of the Examples and the Comparative examples above show that beneficial effects were obtained according to the method of the present invention in that oxidization and yellowing of the micro solder spheres could be restrained, and also deformation of the micro solder spheres due to the external pressure could be prevented, as is apparent from a comparison of the Examples 1 and 2 with the Comparative Examples 1 and 2, and further, that deformation and dispersion induced by the micro solder spheres adhering to the packaging material due to static electricity could be prevented, as is also apparent from a comparison of Examples 1 and 2 with Comparative Examples 3 and 4.

| REFERENCE SIGNS LIST | |
|---|---|
| 1 | Package unit |
| 2 | Container |
| 2a | Container body |
| 2b | Inner lid member |
| 2c | Outer lid member |
| 2d | Vertical flange of the outer lid member |
| 2e | Horizontal flange of the container body |
| 2f | Raised portion |
| 2g | Shoulder of the container body |
| 2h | Horizontal flange of the inner lid member |
| 3 | Deoxidizing and drying agent |
| 4 | Bag member |
| 5 | Holding member |
| 6 | Micro solder spheres |
| 7 | Container body |
| 8 | Opening |
| 9 | Lid member |
| 10 | Lug |
| 11 | Lower plate member |
| 12 | Receptacle |
| 13 | Bump |
| 14 | Upper plate member |
| 15 | Downward protrusion |
| 16 | Hole |
| 17 | Protrusion |
| 18 | Recess |
| 19 | Recess |

-continued

| REFERENCE SIGNS LIST | |
|---|---|
| 20 | Connecting member |
| 21 | Weakened area |

The invention claimed is:

1. A storing package unit for micro solder spheres, comprising:

a container comprising an air permeable material in which micro solder spheres are contained, said container having a container body and a lid member for covering an opening of said container body;

a holding member having a receptacle for receiving said container;

a deoxidizing and drying agent disposed externally to said container; and a bag member impermeable to air, in which said container, said holding member, and said deoxidizing and drying agent are contained and which is sealed in an air-tight condition.

2. A storing package unit for micro solder spheres in accordance with claim 1, in which the inside of said bag has been air evacuated.

3. A storing package unit for micro solder spheres in accordance with claim 1, wherein said holding member has a plurality of said receptacles for said containers, said containers being held in fixed positions relative to each other.

4. A storing package unit for micro solder spheres in accordance with claim 1, in which said holding member is adapted to encompass said container.

5. A storing package unit for micro solder spheres in accordance with claim 1, in which said holding member has a bump.

6. A storing package unit for micro solder spheres in accordance with claim 1, in which said deoxidizing and drying agent is disposed externally to said holding member and said holding member has air permeability.

7. A storing package unit for micro solder spheres in accordance with claim 1, in which said holding member comprises an air permeable material.

8. A storing package unit for micro solder spheres in accordance with claim 1, in which said holding member has a vent hole.

9. A storing package unit for micro solder spheres in accordance with claim 1, in which said holding member has a recess for allowing said deoxidizing and drying agent to be seated in place.

10. A storing package unit for micro solder spheres in accordance with claim 1, in which said container has conductivity.

11. A storing package unit for micro solder spheres in accordance with claim 1, in which said container is made of polyethylene terephthalate.

12. A storing package unit for micro solder spheres in accordance with claim 1, in which said holding member is made of polyethylene terephthalate.

* * * * *